United States Patent [19]

George

[11] Patent Number: 4,930,579

[45] Date of Patent: Jun. 5, 1990

[54] FIRE EXTINGUISHING DEVICE FOR THE HOME HEATING PLANT UTILIZING AN EXISTING SPIGOT AS THE WATER SOURCE

[76] Inventor: Gary George, 100 Kings Grant, Weston, Mass. 02193

[21] Appl. No.: 396,740

[22] Filed: Aug. 18, 1989

Related U.S. Application Data

[63] Continuation of Ser. No. 158,986, Feb. 18, 1988, abandoned.

[51] Int. Cl.[5] ..... A62C 3/00

[52] U.S. Cl. ..... 169/54

[58] Field of Search ..... 169/5, 16, 37, 54, 66; 239/195, 200, 208, 588, DIG. 15

[56] References Cited

U.S. PATENT DOCUMENTS

| | | | |
|---|---|---|---|
| 724,129 | 3/1903 | Schrader | 285/256 |
| 1,058,968 | 4/1913 | Hammond | 169/5 |
| 1,491,212 | 4/1924 | Thomson | 239/525 X |
| 1,826,072 | 10/1931 | Hamilton | 169/37 |
| 2,017,841 | 10/1935 | Coleman | 239/208 |
| 2,759,765 | 8/1956 | Pawley | 239/588 |
| 2,807,502 | 9/1957 | Tharp | 239/588 X |
| 2,853,262 | 9/1958 | Reimann | 239/588 X |
| 4,047,570 | 9/1977 | Munk | 169/16 |
| 4,091,876 | 5/1978 | Valdatta | 169/62 |
| 4,248,309 | 2/1981 | Hofle et al. | 169/47 |
| 4,484,634 | 11/1984 | Swanson | 169/16 X |

OTHER PUBLICATIONS

Instructional Page CA-10B, for, "Model G Automatic Sprinkler", by the Reliable Automatic Sprinkler Co., Inc., New York (Sep. 1983).

*Primary Examiner*—Joseph F. Peters, Jr.
*Assistant Examiner*—Anne Sartelle
*Attorney, Agent, or Firm*—Hamilton, Brook, Smith & Reynolds

[57] ABSTRACT

An automatic fire sprinkler of commercial grade is installed in a domestic dwelling independent of existing plumbing and without alteration of the plumbing in the dwelling. The automatic sprinkler head is connected to one end of a flexible hose. The opposite end of the hose is connected to an existing spigot to the water supply of a central heating unit, hot water heater or the like. The spigot may be a drain outlet or other outlet. The opposite end of the hose may also be connected to a water faucet which provides water to the domestic clothes washing machine. The fire sprinkler head is hung above the heat system or clothes washer/dryer. In response to a fire the sprinkler automatically sprays water from the existing water supply to the immediate area.

25 Claims, 2 Drawing Sheets

SPRINKLER HEAD
MODIFIED OR MANUFACTURED
TO INCLUDE HOSE BARB

FIRE EXTINGUISHING DEVICE FOR THE HOME HEATING PLANT UTILIZING AN EXISTING SPIGOT AS THE WATER SOURCE

This is a continuation of co-pending application Ser. No. 07/158,986 filed on Feb. 18, 1988 abandoned.

BACKGROUND OF THE INVENTION

1. Field of the Invention

This invention relates to a fire extinguishing device for the central heating system in the private residence, which requires no tools to install, and which is much less expensive to implement than current automatic fire sprinkler configurations.

2. Prior Art Statement

Residential fires cause 75% of all fire related deaths, and fire generated in the central heating plant is the leading cause of those fires. Smoke detectors detect fires that start in the kitchen, fireplace and other areas in the living area where such detectors are usually installed, but fires that start in the basement will progress to involve much of the structure of a house before smoke reaches the smoke detectors. Smoke detectors do nothing to inhibit a fire, and they make no contribution when nobody is home.

Automatic fire sprinklers are very effective in the control of undetected fires. They are widely installed in commercial and public buildings because they are required by building codes and/or their installation results in substantial savings in the cost of fire insurance. This proven method of fire control has not been required in the home, save a few states that require sprinklers for new construction only. A home owner that wants to add automatic fire protection to his or her home will find that the components are largely not available, and the installation is beyond the skills of the homeowner and the average residential plumber.

Accordingly, there is a need for an automatic-type fire sprinkler system which can be easily and inexpensively installed in the home by a home owner.

SUMMARY OF THE INVENTION

The present invention makes it possible for anyone to install a commercial grade automatic fire sprinkler over the home heating plant, at a very low cost, without tools and without professional help. It is a feature of this invention to provide an automatic fire extinguishing device for a heat system of the home, and in particular, for the home central heating system, the home hot water heating system and domestic clothes dryer.

Another feature is to provide fire arresting capability in the home that does not require human intervention to operate or initiate.

Another feature is to provide fire arresting capability without changing or altering the existing plumbing of the home.

In accordance with the foregoing features, an automatic fire extinguishing device of the present invention employs an automatic sprinkler head and a water transfer line. The automatic sprinkler head (or similar spray means) is of the type which is heat activated and automatically operates at a predetermined temperature. The transfer line is preferably a flexible tubing or any other suitable means for connecting the sprinkler head to a water supply. One end of the hose is connected to the sprinkler head, and the opposite end of the hose is connected to an existing port of a water supply in the home.

The existing port may be the drain spigot or any other spigot to the water supply of the hot water heater or the central heating plant of the hot water, steam or gravity type, known to be used in a domestic dwelling, trailer home, recreational vehicle, or the like. The connection to the existing port provides the sprinkler head with a reservoir of water from which the sprinkler head automatically draws and sprinkles water in response to a fire.

The hose or transfer line is independent from plumbing lines which exist in the dwelling and is thus able to be installed without altering the existing plumbing of the home.

In addition, the end of the transfer line connected to the existing port may utilize a standard domestic garden hose female fitting to readily connect to the existing port.

The sprinkler head may have a wire loop attached to it to provide a means for hanging the sprinkler head in a suitable and desirable position. Preferably the sprinkler head is mounted above the heat system for which automatic fire extinguishing measures are sought.

In addition, the sprinkler head may have a threaded male port for receiving and connecting to the transfer line. In order to connect such a sprinkler head to a hose whose receiving end is not properly threaded, an adaptor is employed to convert the threaded male port into a port having a push-in type connection to the hose. The adaptor preferably comprises an element known as a hose barb which has a wide end that fits on the male port of the sprinkler head and an opposite narrow end which is pushed into and engages in the receiving end of the hose. A clamp may be used to secure the hose end to the hose barb.

Alternatively, the sprinkler head may be manufactured such that the port of interest includes a hose barb for connection to a female threaded pipe.

In an alternative application of the present invention, the device may provide protection against fire generated by a domestic dryer. In this case, the opposite end of the transfer line is connected to the faucet or other outlet that supplies water to the washer. This provides a water source for the sprinkler head which is connected to the one end of the transfer line. The sprinkler head is mounted or hung above the dryer. In response to a fire or surrounding temperature which rises above a predetermined amount, the sprinkler head automatically sprays water drawn from the faucet to the immediate area.

The transfer line may be connected to the faucet by a T-coupling which allows water to flow to the washer as well as to the sprinkler head.

DETAILED DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENT

Figure 1:
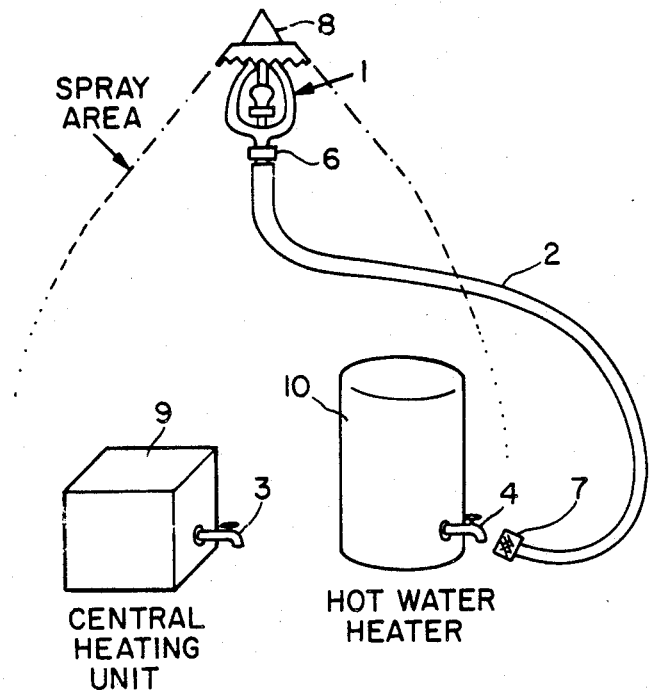
FIG. 1 is a schematic illustration of an automatic fire extinguishing device embodying the present invention.

Reference is now made to FIG. 1 of the drawing which illustrates one exemplary embodiment of the automatic fire extinguishing device as it is connected to a standard home hot water heater 10. The automatic sprinkler head 1 is any one of a variety of commercial grade sprinkler heads and one example is the Model G Automatic Sprinkler manufactured by the Reliable Automatic Sprinkler Co., Inc., 525 North MacQuesten Parkway, Mount Vernon, N.Y. 10552. The sprinkler head will be chosen to activate at a temperature that is above the normal ambient temperature in the area of the common home hot water heater 10 and the subject home heating plant 9 that is usually located nearby, but below the typical kindling temperature of the standard structure and wall covering materials found in the average home hot water heater and home heating plant location. The sprinkler head 1 is attached to one end of a flexible hose 2 of suitable length to elevate the sprinkler head 1 over the heating plant 9. The hose 2 is connected to a male threaded port of the sprinkler head 1 by a cooperating threaded port-to-hose adaptor 6. The other end of the hose 2 is terminated with a standard female garden hose fitting or connector 7 suitable for connecting the hose to the home heating plant drain 3, the hot water heater drain 4, or the clothes washer water supply spigot 5 discussed later. The sprinkler head 1 is equipped with a simple, fire proof hanger 8 of sufficient strength to hold the device in place as it projects water during operation.

To install and use the automatic fire extinguishing device of the present invention, a home owner simply hangs the automatic sprinkler head 1 by its fireproof hanger 8 on a suitable attaching means connected to the ceiling of the area in which automatic fire extinguishing protection is sought. The user connects the opposite end of the hose with the female connector 7 to either the drain spigot of the hot water heater 4 or to the spigot of the heating plant drain 3. The spigots are set in an open position such that the respective drain is open and allows unlimited flow of water to the automatic sprinkler head 1. The user leaves the device in this position to provide automatic fire extinguishing protection.

When the hot water heater or central heating plant malfunctions and causes an increase in ambient temperature, the automatic sprinkler head 1 will sense a rise in ambient temperature and activate at a predetermined temperature. Upon activation of the automatic sprinkler head 1, the sprinkler head projects water from the reservoir created through the opened spigot to which the other end of the hose 2 is connected. The projected water covers the immediate area which includes the malfunctioning central heating plant and/or hot water heater to extinguish any fire caused by either item or by a neighboring item.

Figure 2:
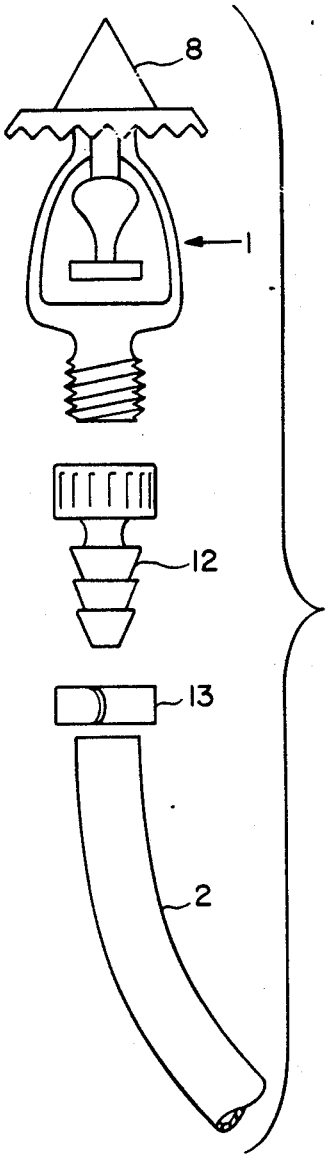
FIG. 2 is an exploded view of a sprinkler head of the embodiment of FIG. 1 modified by an adaptor which provides push-in type coupling to a flexible hose.
Figure 4:
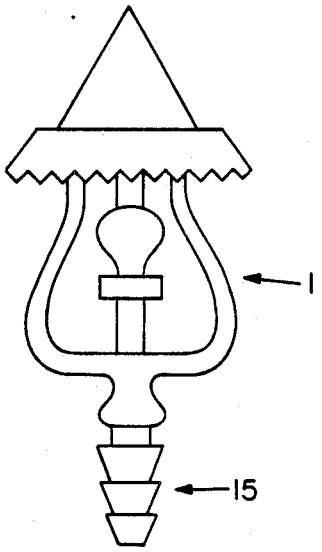
FIG. 4 is a perspective view of another sprinkler head which may be used in the embodiment of FIG. 1.

The sprinkler head 1 may optionally be configured with a port that connects to the one end of hose 2 in a push-in manner, with or without a securing clamp 13 as shown in FIGS. 2 and 4. This is accomplished in one of two ways. In the case illustrated in FIG. 2, a hose barb 12 has a wide end which cooperates with the male threaded port of the sprinkler head 1 and an opposite narrow end which is pushed into and thereby engaged in the end of the hose 2. A clamp 13 is used to secure the hose end to the hose barb 12. In a second case illustrated in FIG. 4, the sprinkler head 1 may be manufactured with a hose barb type port 15 instead of the male threaded port. The same type of push-in connection to hose 2 with or without a securing clamp 13 as described above is used.

Hose 2 may be any flexible tube or tubing capable of delivering a sufficient amount of fluid (i.e. water) to the sprinkler head 1.

The automatic fire extinguishing device of the present invention may also be applied to the domestic clothes washer and dryer area of the home.

Figure 3:
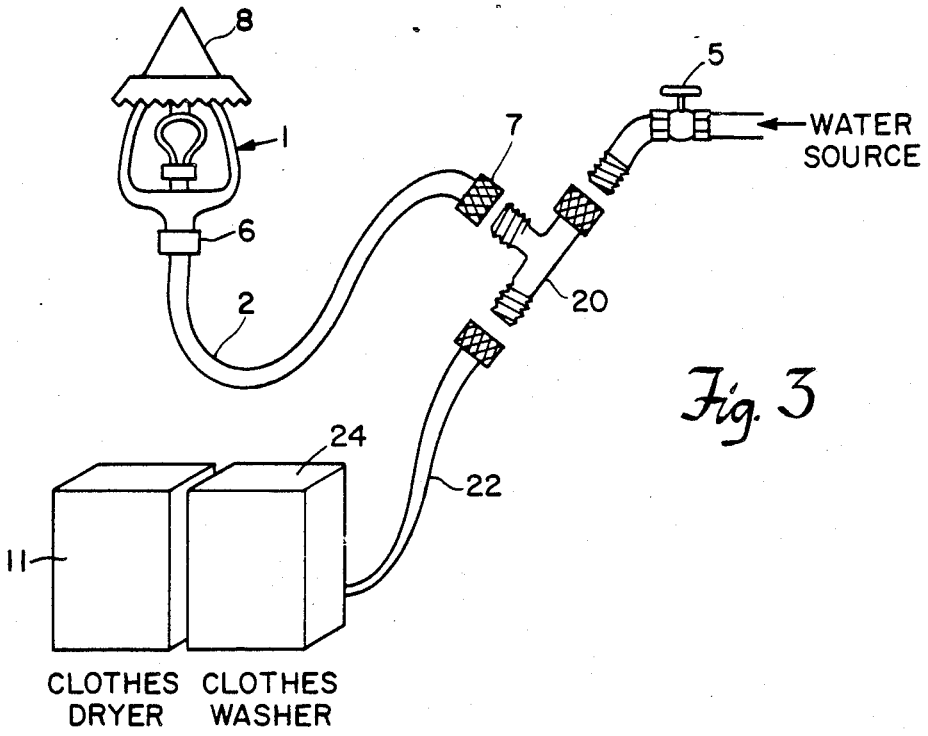
FIG. 3 is a schematic illustration of another embodiment of the present invention which connects to a domestic clothes washer water source.

In this application, a T-coupling 20 is connected to the water source of the washer as shown in FIG. 3. One port of the T-coupling 20 is connected to the faucet end 5, another port of the T-coupling is connected to the hose 22 delivering water to the washer 24 and the third port of the T-coupling is connected to the female hose connector 7 of the other end of the hose 2. The sprinkler head 1 of hose 2 is connected as described above and is positioned over the clothes washer 24 and/or dryer 11. The water faucet 5 is left open to serve as a continuous water source for the sprinkler head 1. The operation of the automatic fire extinguishing device then follows as described in the previous application.

As illustrated by the foregoing embodiments and applications, the present invention provides an automatic type fire sprinkler system which can be easily and inexpensively installed in the home by a home owner. No professional tools are required to install the device of the present invention, and no human intervention is required to initiate the activation of the device once the device is installed. Further, the device does not require the changing or altering of existing plumbing but rather uses an existing drain or spigot to any existing water supply. In particular, the device utilizes the drain spigot on the hot water heater or the central heating plant unit of the home, or the clothes washer water supply spigot. Other outlet ports of such water supplies are suitable.

It is understood that the term "home" is used loosely. The device may be used in any trailer home, recreational vehicle and the like which is equipped with a heating unit with an adjacent or associated water supply. Similarly the central heating plant referred to may be of the hot water, steam or gravity type, or the like.

While the invention has been particularly shown and described with reference to a preferred embodiment thereof, it will be understood by those skilled in the art that various changes in form and details may be made therein without departing from the spirit and scope of the invention as defined by the appended claims. For example, the hose may include a copper tubing which provides a tap into an existing water pipe.

What is claimed is:

1. A portable automatic fire extinguishing device retrofit in an area of a domestic dwelling in which a water dependent heat system with a dedicated water supply has been previously installed, the device comprising:

spray means which automatically operate at a predetermined temperature; and a transfer line having one end disengageably connected to the spray means and an opposite end disengageably connected to a pre-existing drain spigot of the water dependent heat system, so as to provide the spray means with a supply of water which is initially supplied to the water dependent heat system from the dedicated water supply and is subsequently drained from the system through the drain spigot and into the transfer line, the spray means automatically spraying water drained from the system through the drain spigot of the system to the area in response to a fire therein, the drain spigot serving as a positive pressure source of water to the transfer line.

2. An automatic fire extinguishing device as claimed in claim 1 wherein the spray means comprises a heat activated sprinkler head.

3. An automatic fire extinguishing device as claimed in claim 1 wherein the transfer line is a flexible tube.

4. An automatic fire extinguishing device as claimed in claim 1 wherein the spray means is adapted to be hung above the heat system.

5. An automatic fire extinguishing device as claimed in claim 1 wherein the opposite end of the transfer line is connected to an existing spigot associated with the water supply.

6. An automatic fire extinguishing device as claimed in claim 1 wherein the opposite end of the transfer line includes a female fitting.

7. An automatic fire extinguishing device as claimed in claim 1 wherein the opposite end of the transfer line is connected to the water supply through a T-coupling.

8. An automatic fire extinguishing device as claimed in claim 1 wherein the spray means comprises:

a heat activated sprinkler head having a threaded male port; and an adaptor connected to the threaded male port to convert the male port into a push-in type connecting port.

9. An automatic fire extinguishing device as claimed in claim 8 wherein the adaptor comprises:

a member having a wide end for fitting to the male port and an opposite narrow end for engaging in the one end of the transfer line; and a clamp to secure the member to the transfer line.

10. A portable automatic fire extinguishing device for an area of a domestic dwelling comprising:

a heat activated spraying means connected to a pre-existing drain spigot of a heat system having a preexisting supply of water, the preexisting supply of water providing a water source for the spraying means in place of a dedicated plumbed water source for the spraying means;

in response to a fire in an immediate area about the device, the spraying means automatically activating and spraying the immediate area with water provided from the supply of water in the heat system drained through the drain spigot of the system, the drain spigot serving as a positive pressure source of the water.

11. An automatic fire extinguishing device as claimed in claim 10 wherein the heat system comprises a hot water heater.

12. An automatic fire extinguishing device as claimed in claim 10 wherein the heat system comprises a hot water central heating unit.

13. An automatic fire extinguishing device as claimed in claim 10 wherein the heat system comprises a steam central heating unit.

14. An automatic fire extinguishing device as claimed in claim 10 wherein the heat system comprises a gravity central heating unit.

15. An automatic fire extinguishing device as claimed in claim 10 wherein the heat sensitive spraying means is connected to the pre-existing drain port by a hose having one end connectable to the spraying means and an opposite end connectable to the drain port.

16. A portable automatic fire extinguishing device for extinguishing fire in a room having a washer and a dryer, the device comprising:

a heat-activated spraying means connected to an outlet of a water supply to the washer, the water supply providing a positive pressure water source for the spraying means and in common with the washer;

the spraying means automatically activating and spraying water in the room in response to a fire therein.

17. An automatic fire extinguishing device as claimed in claim 16 wherein the heat-activated spraying means is connected to the outlet by a hose having one end connectable to the spraying means and an opposite end connected to the outlet through a T-coupling.

18. An automatic fire extinguishing device as claimed in claim 16 further comprising means for hanging the spraying means over the protected area.

19. An automatic fire extinguishing device for an area of a domestic dwelling comprising:

automatic spray means; and a flexible line having means for connecting said line to the spray means and having an opposite end with means for retrofit to a pre-existing drain spigot of an existing water dependent heat system, the drain spigot providing a positive pressure source of water, and the automatic spray means and flexible line being portable.

20. A method of automatically extinguishing fire in an area of a domestic dwelling in which a water dependent heat system with a dedicated water supply is positioned, the method comprising the steps of:

positioning a portable heat-activated spray means in the area; and connecting the spray means to a pre-existing drain spigot of the water dependent heat system such that the water supply serves as a common positive pressure water source for the spray means and the system, the spray means automatically spraying water drained and flowing from the water dependent heat system through the drain spigot, on the area, in response to a fire therein.

21. A method as claimed in claim 20 wherein the step of positioning the spray means includes hanging the spray means by a wire loop connected to the spray means.

22. A method as claimed in claim 20 wherein the step of connecting the spray means to the drain port of the water supply includes:

connecting one end of a hose to the spray means; and connecting an opposite end of the hose to the drain port of the water supply.

23. A method as claimed in claim 20 wherein the step of connecting the spray means to the drain port of the water supply includes:

connecting one end of a flexible line to the spray means; and connecting an opposite end of the flexible line to the drain port of the water supply.

24. A method of automatically extinguishing fire in a domestic dwelling room having a laundry washer hookup to a water supply, the steps comprising:

positioning a portable heat-activated spray means in the room;

connecting the spray means to the washer hookup in parallel with a washer such that the spray means draws water from the water supply through the washer hookup to automatically spray the room in response to a fire therein.

25. An automatic fire extinguishing system comprising:

a water dependent heat system having a dedicated water supply and a pre-existing drain spigot which is secondary to a primary purpose outlet of the water dependent heat system, the water dependent heat system installed in an area of a dwelling; and a retrofit automatic sprinkler device having:

(a) spray means which automatically operate at a predetermined temperature; and (b) a transfer line having one end disengageably connected to the spray means and an opposite end disengageably connected to the pre-existing drain spigot of the water dependent heat system, so as to provide the spray means with a supply of water which is initially supplied to the water dependent heat system from the dedicated water supply and subsequently drained from the water dependent heat system through the drain spigot and into the transfer line, the spray means automatically spraying water drained through the drain spigot in response to a fire in the area.

* * * * *